US005605881A

United States Patent [19]

Machida et al.

[11] Patent Number: 5,605,881

[45] Date of Patent: Feb. 25, 1997

[54] CLEANING LIQUID FOR RECYCLING COPY MEDIUM FOR ELECTROPHOTOGRAPHY

[75] Inventors: Junji Machida, Toyonaka; Masazumi Yoshida, Amagasaki; Kaoru Furusawa, Toyonaka, all of Japan

[73] Assignee: Minolta Co., Ltd., Osaka, Japan

[21] Appl. No.: 297,933

[22] Filed: Aug. 31, 1994

[30] Foreign Application Priority Data

| | | | |
|---|---|---|---|
| Sep. 3, 1993 | [JP] | Japan | 5-219827 |
| Sep. 3, 1993 | [JP] | Japan | 5-219828 |
| Mar. 11, 1994 | [JP] | Japan | 6-041127 |

[51] Int. Cl.[6] ..... C11D 3/386

[52] U.S. Cl. ..... 510/166; 510/392; 510/167; 510/168; 510/169; 510/170

[58] Field of Search ..... 252/142, 143, 252/170, 171, 174.19, DIG. 4, 173; 162/5; 510/166, 167–170, 392

[56] References Cited

U.S. PATENT DOCUMENTS

| | | | |
|---|---|---|---|
| 3,816,318 | 6/1974 | Hentschel | 252/89 |
| 4,537,706 | 8/1985 | Severson, Jr. | 252/545 |
| 4,714,565 | 12/1987 | Wevers et al. | 252/174.19 |
| 4,863,628 | 9/1989 | Nambudiry | 252/132 |
| 5,110,412 | 5/1992 | Fuentes et al. | 162/5 |
| 5,259,969 | 11/1993 | Srivatsa et al. | 252/60 |
| 5,288,369 | 2/1994 | Ishibashi et al. | 162/5 |
| 5,364,501 | 11/1994 | Baret et al. | 162/5 |
| 5,405,495 | 4/1995 | Cosper et al. | 162/5 |
| 5,441,601 | 8/1995 | Cosper et al. | 162/5 |

FOREIGN PATENT DOCUMENTS

| | | |
|---|---|---|
| 0118933 | 9/1984 | European Pat. Off. . |
| 50-156440 | 12/1975 | Japan . |
| 63-165591 | 7/1988 | Japan . |
| 2-229290 | 2/1990 | Japan . |
| 4-65496 | 2/1992 | Japan . |
| 4-66685 | 3/1992 | Japan . |
| 4-89271 | 3/1992 | Japan . |
| 9113142 | 9/1991 | WIPO . |

*Primary Examiner*—Paul Lieberman
*Assistant Examiner*—Kery Fries
*Attorney, Agent, or Firm*—Burns, Doane, Swecker & Mathis, LLP

[57] ABSTRACT

The present invention relates to a cleaning liquid which is used for removing an image forming material containing a resin component from surface of a recording medium on which an image is formed by the image forming material in order to permit the recording medium serviceable again as a recording medium, characterized by comprising water, a gelatinizer or a swelling agent which is compatible with water and gelatinizes the resin component of the image forming material, and an enzyme.

10 Claims, No Drawings

CLEANING LIQUID FOR RECYCLING COPY MEDIUM FOR ELECTROPHOTOGRAPHY

BACKGROUND OF THE INVENTION

1. Field of the Invention

The present invention relates to cleaning liquid which is used for eliminating an image formed on a recording medium in order to permit the recording medium serviceable again as a recording medium for image reproduction.

2. Description of the Prior Art

Techniques of recording an image on a recording medium by the use of an image forming material, have been widely used as an intelligence communication means. For example there have been known copying machines, printers, facsimiles and the like, in which an image is reproduced by fixing an image forming material, i.e., toner, on a recording medium, i.e., ordinary paper or transparent resin film (OHP sheet) by the help of electrophotographic techniques, and also known an ink-jet printer and the like in which an image is reproduced by an image forming material like water-soluble or oil-soluble ink on a recording means as above mentioned. Thus obtained images are usually required to have such properties as not to deteriorate even after a long-term preservation so that the image forming material which is forming an image is made to strongly adhere to the recording medium. The most commonly used recording medium is paper like ordinary paper and paper has a network structure where pulp fibers are tangled with each other complicatedly. As a result the image forming material also tangles with the network structure to form a very firm adhesion. Particularly when an image reproduction is done on an ordinary paper by the use of an image forming material containing resin component such as toner and the like, the resin component will permeate deeply into fiber of the ordinary paper because of the applied pressure or heat, which yields an extremely strong adhesion.

Meanwhile it has been proposed recently to recycle the above mentioned recording medium as a resource from the view point of an environmental protection. For instance, the ordinary paper is made from pulp and although such recycling method of paper is well-known that: the ordinary paper having a recorded image thereon is dissolved as it is or after being subjected to a shredder, into a fibrous state to separate the image forming material from fiber, and then thus separated image forming material is discharged out of the apparatus by means of a floatater or washing apparatus and thereafter the fiber is bleached followed by treatments in paper manufacturing process to yield a reclaimed paper. In this method, however, the process becomes very complicated and requires a great quantity of chemicals, water and energy, etc. In other words the process has been confronting environmental and economical troubles.

Further thus reclaimed paper has been suffering from such problems that: it shows poor toughness and tensile strength because of finely cut fiber in the reclaiming process, and for this reason paper powder is likely to be generated during a new image reproduction process, resulting in such unfavorable influences on the recording medium incorporated in a copying machine and the like as shortening of serviceable period of, for example, developer and photosensitive material; and that the image forming material separated during the reclaiming process may adhere again to the fiber so that the reclaimed paper will not be provided with sufficient whiteness.

To solve such problems a recycling method may be proposed wherein an image is eliminated in a cleaning process free from cutting of the recording medium on which the image is recorded. But the adhesion of the image forming material to the recording medium is often very firm. Particularly when paper like ordinary paper is used as a recording medium it is difficult to provide cleaning liquid capable of attaining sufficient cleaning effect because of the network structure of pulp fiber. Namely, even when the image forming material on a paper surface is subjected to cleaning, the network structure will retain the image forming material within its inside. Therefore cleaning liquid which simply dissolved the image forming material can not remove the remaining image forming material sufficiently.

Further in case that the recording medium is for purposes of Overhead Projector (OHP) sheet, the surface thereof is often coated with a resin layer which is adhesive to the resin component of the toner, which provides an extremely strong fixation. Thus it has been very difficult to remove toner by the conventional cleaning liquid.

Japanese Patent Laid-Open No. Hei 4-356089 discloses a recycling method in which toner, which is an image forming material, is permitted to contain specific material such as bio-degradable plastic and photodegradable plastic, etc., and the recording paper printed by such toner is reclaimed.

The recycling method as above, however, can be applicable only to the recording paper printed by the toner which contains specific material as bio-degradable plastic and photo-degradable plastic. In general toners commonly used in copying machines and printers, etc., at present seldom contain a specific material as above. Therefore the art disclosed in the above Laid-Open Patent is hardly adoptable in reclaiming the recording paper which bears records thereon and is wasted in great amounts. So it can be said that the art lacks universality.

SUMMARY OF THE INVENTION

Object of the present invention is, therefore, to provide cleaning liquid which can overcome the above stated problems and especially to provide the cleaning liquid which can effectively eliminate an image forming material from a recording medium even when the image is formed on the means by an image forming material containing resin as its component which is difficult to remove.

Another object of the invention is to provide a universal cleaning liquid which is applicable to any types of image forming material regardless of kinds of resin contained in the image forming material.

Still another object of the invention is to provide cleaning liquid which can conduct cleaning of the printed surface of the recording medium without cutting paper when paper such as ordinary paper is used as a recording medium and which can contribute to manufacturing of reclaimed paper with improved whiteness.

Further object of the present invention is to provide cleaning liquid which can contribute to manufacturing of reclaimed paper with improved whiteness even when paper such as ordinary paper is used as a recording medium and is cut in recycling process.

The present invention is based on a discover that resin components contained in an image forming material can be cleaned effectively by a cleaning liquid comprising water, an enzyme and either a gelatinizer or a swelling agent, which leads to an accomplishment of the present invention.

DETAILED DESCRIPTION OF THE INVENTION

The present invention provides a cleaning liquid which is used for removing an image forming material containing a resin component from surface of a recording medium on which an image is formed by the image forming material in order to permit the recording medium serviceable again as a recording medium, characterized by comprising water, a gelatinizer or a swelling agent which is compatible with water and gelatinizes the resin component of the image forming material, and an enzyme.

The present cleaning liquid is applicable to varieties of image forming materials including various kinds of ink and marker and is not particularly limited in its objectives but it shows a prominent cleaning effect when used for toners employed in an electrophotography where the conventional recycling methods have been difficult in attaining a sufficient cleaning effect. In other words toner is functional particles containing resin component which serves as fixing component, and coloring component, etc., and has a strong bonding force acting between the resin component and the recording medium such as paper and OHP film, etc., which leads to difficulties in satisfactory cleaning. The present cleaning liquid, however, can provide a sufficient and speedy cleaning effect.

The cleaning liquid according to the present invention can be used independent of kinds of resin components contained in toner and can achieve satisfactory cleaning even in case that the toner contains resin component of the conventionally known types.

Next explanations will be made referring to examples of the cleaning liquid composition as well as their functions in case that an image forming material is toner containing resin component.

The present cleaning liquid contains as its essential components, at least water, an enzyme and either a gelatinizer or a swelling agent.

Water, when the recording medium is ordinary paper or the like, swells pulp fiber of the paper to remove the image forming material efficiently which is entering into the network of pulp fiber. Also by containing water the present cleaning liquid is permitted to have a higher boiling point, which leads to an improved nonvolatility, as compared with the common cleaning liquids comprising organic solvents. As a result such advantages are attained that: the liquid becomes less toxic and not only inflammability is lowered but also concentrations of other liquid components get stable causing the liquid quality less variable. Further water addition is essential for the purpose of utilizing enzymes in an active state. The water content is within a range from 1–90% by weight based on the whole cleaning liquid, preferably from 20–88% by weight and more preferably from 30–85% by weight. When the water content is less than 1% by weight, fiber-expanding effect may not be attained satisfactorily when the recording medium is paper and the like. Whereas too much water content may prolong the required time for cleaning (required time from the immersion of the recording medium into the cleaning liquid to the completion of cleaning via physical treatment), which will result in a lowered cleaning efficiency per unit time. Although it may vary with the kinds of the toner, water content exceeding 90% by weight will cause a prolonged time required for cleaning, which is not favorable. Furthermore, too much water may weaken the bonding force (hydrogen bonding) between fiber themselves so that when physical treatment are carried out in the cleaning process, paper surface will be easily damaged or paper fiber will be readily cut, which is not desirable.

A gelatinizer in the present invention plays an important role in converting the resin component contained in the image-forming material into plastic polymers in gel state. Namely, by gelatinizing resin component which is firmly fixed to the recording means, the cleaning is carried out easily. Since the present cleaning liquid contains water as explained above, the gelatinizer is required to have a compatibility with water. As such compounds that satisfy the required properties, monoesters of divalent organic acids, may be exemplified.

The bivalent organic acid, which is one component of the monoester of bivalent organic acid, may be exemplified by saturated or unsaturated aliphatic acids, such as oxalic acid, malonic acid, succinic acid, glutaric acid, adipic acid, pimelic acid, suberic acid, azelaic acid, sebacic acid, maleic acid and fumaric acid, and aromatic carboxylic acids, such as phthalic acid, isophthalic acid and terephthalic acid. Among those acids, the saturated aliphatic acids, such as oxalic acid, malonic acid, succinic acid, glutaric acid, adipic acid, pimelic acid, suberic acid, azelaic acid and sebacic acid are preferable.

The alcohol, which is the other component of the monoester of bivalent organic acid, may be exemplified by univalent alcohols (which may be straight or branched), such as methanol, ethanol, propanol, butanol and pentanol, polyvalent alcohols, such as ethylene glycol, glycerin, pentaerythritol and sorbitol, glycols, such as diethylene glycol, dipropylene glycol and polyethylene glycol, and Cellosolves, such as ethyl Cellosolve and butyl Cellosolve. The alcohol may be used singly or in combination with other alcohols.

The monoester of bivalent organic acid may be prepared by esterification reaction of the bivalent organic acid with the alcohol, or hydrolysis reaction of a diester of the bivalent organic acid.

Preferable monoesters of bivalent organic acid may be represented by the following formula:

$$HOOC—(CH_2)_n—COOR_1$$

in which $R_1$ represents an alkyl group having 1 to 5 carbon atoms and the letter "n" represents an integer of 0 to 8.

The monoester of bivalent organic acid represented by the above formula is particularly exemplified by:

monoester of oxalic acid ($HOOC—COOR_1$),
monoester of malonic acid ($HOOC—CH_2—COR_1$),
monoester of succinic acid ($HOOC—(CH_2)_2—COR_1$),
monoester of glutaric acid ($HOOC—(CH_2)_3—COR_1$),
monoester of adipic acid ($HOOC—(CH_2)_4—COR_1$),
monoester of pimelic acid ($HOOC—(CH_2)_5—COR_1$),
monoester of suberic acid ($HOOC—(CH_2)_6—COR_1$),
monoester of azelaic acid ($HOOC—(CH_2)_7—COR_1$),
monoester of sebacic acid ($HOOC—(CH_2)_8—COR_1$)
and a mixture thereof.

Among those monoesters, the one in which $R_1$ is methyl, ethyl or propyl is preferable from the viewpoint of water solubility. The monoester of bivalent organic acid may be used singly or in combination with other monoesters.

A content of the gelatinizer is within the range from 60–5% by weight based on the whole cleaning liquid, preferably from 40–20% by weight. An amount exceeding 60% by weight will cause an elevated solubility of the resin component of the toner and consequently the resin is likely to adhere to paper again. Whereas an amount less than 5% by weight may result in an insufficient gelatinization of the resin component of the toner, causing a lowered cleaning effect.

Enzymes in the present invention may be used in single or in a combination of two or more kinds. Enzymes provide the most satisfactory cleaning effect when used in combination with the above described gelatinizers. The reason for this is not yet clear but the mechanism is assumed to be as follows.

When the recording medium on which an image is reproduced by toner, is immersed into the cleaning liquid, the resin component in the toner, which is fixing to paper or OHP film, absorbs the gelatinizer to expand to 0.5 mm—several centimeters and it becomes viscous macromolecules having a high plasticity in a gel form. But these viscous macromolecules in a gel form show strong bonding force to paper fiber and OHP film in particular, so that it becomes difficult to remove gel macromolecules which are slipping deeply into network of paper fiber. Further when the gel macromolecules thus swollen are tried to be removed from OHP film or paper by a physical means, for example, by wiping out with cloth, there occurs a risk that they will adhere again to none-image parts to pollute the whole film or paper.

However, when an enzyme is added in addition to the gelatinizer, the gel macromolecules are acted by enzymes to decompose in their inner bonding to become low molecular weight compounds. Thus the macromolecules are decomposed to fine powdery molecules of about 0.01–0.1 mm or less and at the same time they drastically lose their bonding force to paper fiber or OHP film, which causes an easy separation from the paper fiber, etc., only by applying weak physical (or mechanical) stress, and thus cleaning is carried out satisfactorily.

More specifically, in case the toner resin was polyester-series resin an addition of lipase-type enzymes to the cleaning liquid containing a gelatinizer was found to enhance the cleaning effect drastically. Such an improved cleaning effect was scarcely recognized in case of the cleaning liquid containing lipase-type enzymes but free from the gelatinizer. Judging from this result it is apparent that the resin component of toner can not be decomposed materially unless the resin component is first converted into gel macromolecules, in spite of the enzyme presence in the cleaning liquid, and as a consequence removal of toner from the recording medium becomes very difficult.

Enzymes applicable in the present cleaning liquid, may include hydrolases, oxidoreductases, transferases, lyases, and isomerases, etc.

As hydrolases there are, for example, lipase-type enzymes, protease-type enzymes, amylase-type enzymes, cellulase-type enzymes, phosphodiesterase-type enzymes, hemicellulase-type enzymes, pectinase-type enzymes, invertase-type enzymes, melibiase-type enzymes, Oringinase-type enzymes, Hesupirinase-type enzymes, lysozyme-type enzymes, acylase-type enzymes, and milk-clotting enzyme, etc.

Oxidoreductases may include: glucose oxidase-type enzymes, catalase-type enzymes, D-amino acid oxidase-type enzymes, and cytochrome C-type enzymes, etc.

Transferases may include nucleoside phosphotransferase-type enzymes, etc.

Regarding lyases, aspartase-type enzymes and fumarase-type enzymes, etc., may be exemplified.

As isomerases, there are, for example, glucose isomerase-type enzymes and D-amino acid lasemaze-type enzymes, etc.

Enzymes as above exemplified may be used singly or in combination. Among the exemplified enzymes hydrolases are preferable from the stand point of resin component decomposition into gel macromolecules. Among hydrolases, lipase-type, protease-type, amylase-type, and cellulase-type are particularly desirable. Furthermore enzyme mixtures of lipase-type with protease-type, and of protease-type with amylase-type or cellulase type are especially preferable from the view point of cleaning effect for toners containing polyester-type resin component.

Examples of favorable hydrolases, i.e., lipase, protease, amylase and cellulase, will be described hereinafter.

Concerning lipase type enzymes, there are Lypase AY (made by Amano Seiyaku K.K.), Lypase M (made by Amano Seiyaku K.K.), Lypase A (made by Amano Seiyaku K.K.), Lypase AP (made by Amano Seiyaku K.K.), Lypase M-AP (Made by Amano Seiyaku K.K.) and Lypase (Saiken) (made by Nagase Sangyo K.K.), etc.

Regarding protease-type enzymes, such may be illustrative as: Bakupro (made by Ueda Kasei K.K.), Acid Protease (made by Kyowa Hakko K.K.), Bioprase (made by Nagase Sangyo K.K.), Bioprase PN-4 (made by Nagase Sangyo K.K.), Bioprase conc. (made by Nagase Sangyo K.K.), Bioprase FG (made by Nagase Sangyo K.K.), Bioprase SA-10 (made by Nagase Sangyo K.K.), Bioprase L (made by Nagase Sangyo K.K.), Bioprase Green W (made by Nagase Sangyo K.K.), Bioprase AL-15 (made by Nagase Sangyo K.K.), Bioprase SP-4 (made by Nagase Sangyo K.K.), Bioprase SN-10 (made by Nagase Sangyo K.K.), Bioprase F (made by Nagase Sangyo K.K.), Bioprase 092 (made by Nagase Sangyo K.K.), Biopron (made by Nagase Sangyo K.K.), Denapsin (made by Nagase Sangyo K.K.), Microbialrennet (made by Meito Sangyo K.K.), Molsin (made by Fujisawa Yakuhin K.K.), Nagarse P (made by Nagase Sangyo K.K.), Newlase (made by Amano Seiyaku K.K.), Orientase (made by Ueda Kasei K.K.), Panprosin (made by Zennihon Seikagaku K.K.), Papain (made by Nagase Sangyo K.K.), Pepcin (made by Mikuni Kagaku K.K.), Perfec (made by Ajinomoto K.K.), Proctase (made by Meiji Seika K.K.), Prolisin (made by Ueda Kasei K.K.), Pronase (made by Kaken Kagaku K.K.), Promen (made by Daiwa Kasei K.K.), Protin-P (made by Daiwa Kase K.K.), Samprose (made by Hankyu Kyoei Bussan K.K.), Samzyme SS (made by Sankyo K.K.), Tasinase A-20-30 (made by Kyowa Hakko K.K.), Tasinase N-11-100 (made by Kyowa Hakko K.K.), Thermoase (made by Daiwa Kasei K.K.), and Thermolysin (made by Daiwa Kasei K.K.).

Amylase-type enzymes may include: α-Amylase (made by Daiwa Kasei K.K.), Amylolisin (made by Ueda Kasei K.K.), Biotamylase (made by Nagase Sangyo K.K.), Biodiastase (made by Amano Seiyaku K.K.), Biokleistase (made by Daiwa Kasei K.K.), Biotex (made by Nagase Sangyo K.K.), Diasmen SS (made by Daiwa Kasei K.K.), Fukutase (made by Ueda Kasei K.K.), Glucozyme (made by Nagase Sangyo K.K.), Glucuzyme (made by Amano Seiyaku K.K.), Glutase (made by Daiwa Kasei K.K.), Hankyuliquitase (made by Ueda Kasei K.K.), Matsulase (made by Matsutani Kagkau K.K.), Rebozyme A-10-2500 (made by Kyowa Hankko K.K.), Rebozyme N-10-2000 (made by Kyowa Hakko K.K.), Rebozyme N-20-1000 (made by Kyowa Hakko K.K.), Sanactase (made by Meiji Seika K.K.), Speedase K & G (made by Nagase Sangyo K.K.), Speedase PN & SP (made by Nagase Sangyo K.K.), Speedase R (made by Nagase Sangyo K.K.), Speedase FN, SF, P (made by Nagase Sangyo K.K.), Speedase S (made by Nagase Sangyo K.K.), Sumizyme (made by Shinnihon Kagaku K.K.), NeoSpeedase (made by Nagase Sangyo K.K.), Sanzyme (made by Sankyo K.K.), and XP-200 (made by Nagase Sangyo K.K.), etc.

Examples of cellulase-type enzymes may include: Cellulase AP (made by Amano Seiyaku K.K.), Cellulosine (made by Ueda Kasei K.K.), Celluzyme (made by Nagase Sangyo K.K.) and Pancellase (made by Zennihon Seikagaku K.K.), etc.

An enzyme content is within 0.001–20% by weight based on the cleaning liquid, preferably from 0.01–10% by weight.

Enzyme act depends on pH value and temperature of the liquid so that the liquid must be controlled to have optimum conditions in correspondence to enzymes employed. In addition, both conversion of toner resin into gel macromolecules and separation action caused by the gelatinizer also depend upon pH value and temperature of the liquid. The pH value and temperature of the cleaning liquid, therefore, must be determined taking all factors into consideration and in general it is preferable that a pH value is within a range from 2.0–11.0 and a temperature of the liquid is from 20°–60° C. In order to attain a stable cleaning effect, it is more preferable that pH value is kept at an optimum constant value by the use of, for instance, McIlvaine buffer solution and phosphate buffer solution, etc. When pH value is below 2.0 or exceeding 11.0, in other words when the liquid is strong acidic or strong alkaline, not only enzyme actions will be lowered but also gelatinization and separation of the toner resin caused by a gelatinizer will be prohibited. While the liquid temperature below 20° C. may restrict both degradation by enzymes and gelatinization by gelatinizer, resulting in a practically unfavorable cleaning effect. When the liquid temperature exceeds 60° C. most enzymes will lower their heat stability so that a stable cleaning effect is seldom achieved for a long period of time.

Instead of or with the gelatinizer, a swelling agent may be used. With respect to swelling agents, they function to swell or dissolve an image forming material, especially resin component contained in the image forming material. Further the swelling agents must have compatibility to water which is added to the present cleaning liquid.

Examples satisfying such requirements may include: acetone, tetrahydrofuran, dioxane, diethylene glycol monoethyl ether, acetonitrile, cyclohexanone, dimethylsulfoxide, ethanol, propanol, and butanol, etc., and they may be used singly or as a mixture of two or more compounds.

A content of the swelling agent as exemplified above is within a range from 99–30% by weight based on the overall cleaning liquid, desirably from 90–40% by weight. An amount less than 30% by weight may cause lowering of dissolving and swelling effects of the image forming material such as toner resin and the like, while an amount exceeding 99% by weight will hinder enzyme action, which leads to a risk of re-adherence of the image forming material to the recording medium.

The cleaning effect is achieved to some extent by swelling or dissolving the image forming material, particularly resin component contained in the image forming material by the action of the swelling agent. However, sometimes acting rate of the cleaning liquid into the bulk inside of the image forming material, or onto the bonding between the image forming material and the recording medium in case the image forming material is permeating into the inside of the recording medium, is slow, and as a result the cleaning can not be carried out efficiently. Further it happens occasionally that because of the firm bonding, responsible for the kind of recording medium, between the swollen resin component of the image forming material and the recording medium, the image forming material will adhere again to the recording medium when the swollen material is intended to be wiped out physically.

The present inventors have found that a combined use of water and the swelling agent as well as the enzyme enables enhanced cleaning rate and prevention of readhesion of the swollen image forming material.

For these purposes enzymes applicable in the present invention are hydrolases, oxidoreductases, transferases, lyases, and isomerases, as described previously.

Additionally, the present cleaning liquid favorably contains a surfactant, optionally. Surfactants act to surround organic components of, for instance, removed resin component, and to prevent the removed image forming material from re-adhering to the recording medium. Further, when the recording medium is paper like ordinary paper, surfactants will slip into the network structure of the paper to surround the image forming material, thus facilitating the cleaning of the image forming material permeating deeply into fiber.

The surface active agent useful in the present invention may be exemplified by an anionic surface active agent, a nonionic surface active agent, a cationic surface active agent, an amphoteric surface active agent and a mixture thereof.

The anionic surface agent may be exemplified by fatty acid esters, alkyl sulfuric esters, alkyl benzene sulfonates, alkyl naphthalene sulfonates, alkyl sulfosuccinates, alkyl diphenyl ether disulfonates, alkyl phosphates, polyoxyethylene alkyl sulfates and formalin condensates of naphthalene sulfonates, and polymeric surfactant of polycarboxylic acids.

The nonionic surface agent may be exemplified by polyoxyethylene alkyl ethers, polyoxyethylene alkyl aryl ethers, copolymers of oxyethylene-oxypropylene, sorbitan fatty acid esters, polyoxyethylene-sorbitan fatty acid esters, polyoxyethylene aliphatic acid ester, glycerine-fatty acid ester and polyoxyethylene alkyl amines.

The cationic surface agent and the amphoteric surface active agent are exemplified by alkyl amine salts, quaternary ammonium salts, alkyl betaines and amine oxides.

A particularly preferable surface active agent is a nonionic surface active agent of polyoxyethylene type represented by following formula:

$$RO(CH_2CH_2O)_nH$$

in which R represents an alkyl group or an alkylphenyl group of $C^{12}$–$C_{22}$; the letter 'n' presents an integer of 1 to 10.

The above surface active agent may be used singly or in combination with each other. A content of the surface active agent is within the range between 0.01 and 10% by weight relative to the total amount of cleaning liquid. If the content is less than 0.01% by weight, the effects caused by addition of the surface active agent can not be achieved. If the content is more than 10% by weight, it is difficult to handle it because of bubbles.

Also the present cleaning liquid can contain an organic acid, if necessary. When the image forming material contains resin component the cleaning liquid must permeate into the inside of the resin. The addition of organic acids can improve the permeation effect, and to shorten the time required for cleaning.

The organic acids useful in the present invention may be exemplified by saturated aliphatic acids, such as formic acid, acetic acid, propionic acid, butyric acid, valeric acid, pivalic acid, caproic acid, caprylic acid, capric acid, lauric acid, myristic acid, palmitic acid and stearic acid, unsaturated aliphatic acids, such as acrylic acid, propiolic acid, methacrylic acid, crotonic acid, oleic acid, linolic acid, erucic acid, ricinolic acid, abietic acid and resin acid, aromatic carboxylic acids, such as benzoic acid, toluic acid, naphthoic acid, cinnamic acid, 2-furic acid, nicotinic acid and isonicotinic acid. The organic acid may be used singly and in combination with other organic acids. As for organic acids, such higher fatty acids are preferable that: lauric acid, myristic acid, palmitic acid, stearic acid, oleic acid, linolic acid, erucic acid, ricinolic acid, abietic acid and rhodinic acid, etc. Further coconut oil, linseed oil, lard, and whale oil, etc., which contain such higher fatty acids, may also be used in the present invention.

An addition amount of the organic acid is favorable from 1–15% by weight based on the overall cleaning liquid. An amount less than 1% by weight will seldom contribute to improvements, while exceeding 15% by weight may cause deterioration of product quality on account of bad influence of the remaining organic acid upon the recording medium.

Still further, the present cleaning liquid which contains the gelatinizer may contain organic solvents for the purpose of swelling the toner, such as, for instance, methanol, ethanol, n-butanol, isopropanol, ethoxyethanol, etc., and a mixture of the above one compound added by xylene, toluene, acetone, THF, dioxane, or dichloromethane and the like.

The cleaning liquid according to the present invention is utilized in such ways that: the recording medium is immersed in the cleaning liquid and while being immersed it is applied by a physical force to remove the image forming material; the recording medium is immersed in the cleaning liquid and after being taken out of the liquid the recording medium is applied by a physical force to remove the image forming material; and the image part is sprayed or coated or immersed by an appropriate amount of the cleaning liquid and then the image forming material is transferred to a suitable separation element by applying heat and/or pressure, and thereafter the image forming material transferred onto the separation element, is removed.

In the present invention the recording media, the objectives of the cleaning liquid, may not be limited in particular and resin film (OHP sheet), in addition to paper such as ordinary paper and reclaimed paper, etc., may be applicable.

As described previously, the image forming material to which the present cleaning liquid is effective, may include various kinds of ink and marker, etc. Particularly the present liquid is remarkably effective to toners employed in electrophotography.

Explanations of toner will be made briefly hereinafter.

Generally toner contains resin component and coloring agent. Further it may contain a charge controller, an offset inhibitor, and a magnetic material, if necessary and is treated with a fluidizer.

The resin that constitutes the toner are, for example, thermoplastic resins or thermosetting resins, such as styrenic resins, acrylic resins, methacrylic resins, styrene-acrylic copolymer resins, styrene-butadiene copolymer resins, polyester resins, epoxy resins, and resins using their copolymers, block copolymers, graft polymers, polymer blends, and the like. For such a resin, its number-average molecular weight Mn should be in the range of $1{,}000<Mn<20{,}000$, preferably $2{,}000\leqq Mn\leqq 15{,}000$. It is desirable that a ratio (Mw/Mn) of weight average molecular weight (Mw) to the number-average molecular weight (Mn) is within the range of $2\leqq Mw/Mn\leqq 80$. For the resin used, preferably, its glass transition point (Tg) is 55° C.–70° C. and softening point is 80° C.–140° C.

Regarding to coloring agents, commonly known varieties of pigments and dyestuffs are employed, among which dyestuff-type coloring agents are usually difficult to be cleaned as compared with pigment-type agents. The reason for this is that the dyestuff-type coloring agents easily permeate into the inside of paper fiber, which is a recording medium, and often they will remain in the paper even after cleaning.

However even toners containing dyestuff-type coloring agents can be cleaned satisfactorily by the present cleaning liquid. Meanwhile dyestuff-type coloring agents sometimes dissolve in the cleaning liquid. In such cases it may be enough for the cleaning liquid circulated so as to eliminate the dyestuffs from the liquid. From the view point of prevention the liquid pollution, pigment-type coloring agents are desirable.

The coloring agents contained in the toner may be as black pigments by way of example, carbon black, copper oxide, manganese dioxide, aniline black, activated carbon, ferrite, magnetite, and the like.

Yellow pigments include chrome yellow, zinc yellow, cadmium yellow, yellow oxide, mineral fast yellow, nickel titanium yellow, navel's yellow, naphthol yellow S, Hansa yellow G, Hansa yellow 10G, benzidine yellow G, benzidine yellow GR, quinoline yellow lake, permanent yellow NCG, tartrazine lake, etc.

Red pigments include red chrome yellow, molybdate orange, permanent orange GTR, pyrazolone orange, vulcan orange, indanthrene brilliant orange RK, benzidine orange G, indanthrene brilliant orange GK, red oxide, cadmium red, red lead, permanent red 4R, lithol red, pyrazolone red, Watchung red, lake red C, lake red D, brilliant carmine 6B, eosine lake, rhodamine lake B, alizarin lake, brilliant carmine 3B, permanent orange GTR, vulcan fast orange GG, permanent red F4RH, permanent carmine FB, etc.

Blue pigments include Prussian blue, cobalt blue, alkali blue lake, Victoria blue lake, phthalocyanine blue, etc.

The toner contains these coloring agents in a quantity range of 1–20 parts by weight, preferably 3–15 parts by weight, relative to 100 parts by weight of the resin of the toner.

A charge-controller may also be used in the toner. Positive charge-controller for toner, for example, include nigrosine base EX, quaternary ammonium salts, polyamine compounds, and imidazole compounds. A negative charge-controller for toner, for example, include azo dyes of chrome complex salt type, copper phthalocyanine dyes, chrome complex salts, zinc complex salts, aluminum complex salts, etc.

The quantity of these charge-controller is preferably 0.1–10 parts by weight, particularly 0.1–5 parts by weight, relative to 100 parts by weight of resin in the toner.

Concerning charge controllers there are two types, dyestuff type and non-dyestuff type, both of which can be cleaned satisfactorily by the present cleaning liquid, as described above. From the standpoint of preventing the liquid pollution, such charge controllers are desirable as: non-dyestuff type, colorless or white type, and those of resin having polar group or functional group, as a constituent resin of the toner.

Usable as the offset inhibitor are low molecular weight polyethylene wax, low molecular weight polyethylene wax of oxidized type, low molecular weight polypropylene wax, low molecular weight polypropylene wax of oxidized type, higher fatty wax, higher fatty ester wax, sazole wax, etc, which may be used singly or in mixture of two or more types.

The quantity of the offset inhibitor used is 1–15 parts by weight, preferably 2–8 parts by weight, relative to 100 parts by weight of resin in the toner.

Magnetic toners applicable in the present invention are those constituted of fine particles of known magnetic materials in resin. Such magnetic materials are, for example, exemplified by metals exhibiting ferromagnetism such as cobalt, iron, and nickel, alloys of such metals as aluminum, cobalt, iron, lead, magnesium, nickel, zinc, antimony, beryllium, bismuth, cadmium, calcium, manganese, selenium, titanium, tungsten, and vanadium, and their mixtures, oxides, and calcined materials. The quantity of the magnetic fine particles preferably added to the toner is 1–80 parts by weight, preferably 5–60 parts by weight, relative to 100 parts by weight of the resin of the toner.

A fluidizing agent may also be used, for example, inorganic fine particles, such as silica particles, titanium oxide particles, alumina particles, magnesium fluoride particles, silicon carbide particles, boron carbide particles, titanium carbide particles, zirconium carbide particles, boron nitride particles, titanium nitride particles, zirconium nitride particles, magnetite particles, molybdenum disulfide particles, aluminum stearate particles, magnesium stearate particles, and zinc stearate particles. These inorganic fine particles are desirably subjected to a hydrophobic treatment with silane coupling agents, titanium coupling agents, higher fatty acids, silicone oil, or the like.

Also, various types of organic fine particles may be used singly or in combination, such as styrene-type, acryl-type, methacryl-type, benzoguanamine-type, silicone-type, Teflon-type, polyethylene-type and polypropylene-type organic particles granulated by a wet polymerization process or vapor phase polymerization process, such as emulsion polymerization, soap-free emulsion polymerization, or non-aqueous dispersion polymerization. These organic fine particles may be used in combination with the inorganic fine particles.

A quantity of the fluidizing agent is 0.05–5 parts by weight, preferably 0.1–3 parts by weight, relative to 100 parts by weight of toner.

The present invention will be described in detail referring to Experiments.

Experiments

| (Toner Preparation Example 1) | |
|---|---|
| Styrene-acrylic copolymer resin (Mn: 12,000, Mw: 168,000, Tg: 59° C., softening point: 130° C.) | 100 parts by weight |
| Carbon black (Raven 1250, made by Colombia Carbon Co.) | 10 parts by weight |
| Low molecular weight polypropylene serving as an offset inhibitor (Viscol 550P, made by Sanyo Kasei Kogyo K.K.) | 3 parts by weight |

were mixed in Henschel Mixer and were kneaded by a bi-axial extrusion kneader followed by cooling. Then the resultant was pulverized roughly, further pulverized finely by means of a jet pulverizer and then classified by an air-classifier to obtain resin-particles having a volume average particles size of 9.5 μm.

Thus obtained resin particles were blended by 0.8% by weight of hydrophobic titanium oxide serving as a fluidizer to give Toner A.

| (Toner Preparation Example 2) | |
|---|---|
| Polyester resin (Mn: 13,500, Mw: 150,000, Tg: 67° C., softening point: 118° C.) | 100 parts by weight |
| Carbon black (Mogul L, made by Cabot K.K.) | 10 parts by weight |
| Low molecular weight polypropylene serving as an offset inhibitor (Viscol TS200, made by Sanyo Kasei Kogyo K.K.) | 3 parts by weight |
| Charge controller (Bontron E-89, made by Orient Kagaku Kogyo K.K.) | 3 parts by weight |

were mixed in Henschel Mixer and were kneaded by a bi-axial extrusion kneader followed by cooling. Then the resultant was pulverized roughly, further pulverized by a jet pulverizer and then classified by an air-classifier to obtain resin-particles having a volume average particle size of 8.3 μm.

Thus obtained resin particles were blended by 0.2% by weight of hydrophobic colloidal silica serving as a fluidizer to give Toner B.

| (Toner Preparation Example 3) | |
|---|---|
| Styrene-acrylic copolymer resin (Mn: 10,000, Mw: 236,000, Tg: 60° C., softening point: 132° C.) | 100 parts by weight |
| Carbon black (MA #8, made by Mitsubishi Kasei K.K.) | 5 parts by weight |
| Low molecular weight of polypropylene serving as an offset inhibitor (Viscol 550P, made by Sanyo Kasei Kogyo K.K.) | 3 parts by weight |
| Charge controller (Bontron N-01, made by Orient Kagaku K.K.) | 3 parts by weight |

were mixed in Henschel Mixer and were kneaded by a bi-axial extrusion kneader followed by cooling. Then the resultant was pulverized roughly, further pulverized finely by a jet pulverizer and then classified by an air-classifier to obtain resin particles having a volume average particle size of 9.5 μm.

Thus obtained resin particles were blended by 0.2% by weight of hydrophobic silica serving as a fluidizer to give Toner C.

Carrier Preparation Example 1

Polyethylene-coated carrier in which surface of ferrite magnetic particle is coated with polyethylene layer, was prepared in accordance with the following process.

(1) Preparation of titanium-containing catalyst component

Dehydrated n-heptane (200 ml) and 15 g (25 mmol) of magnesium stearate which was vacuum desiccated (under 2 mmHg) at 120° C., were introduced at a room temperature, into a flask of inner volume of 500 ml which was purged by argon previously, to give slurry.

(2) Activity evaluation of titanium-containing catalyst component

Into an autoclave having an inner volume of 1,000 ml and purged by argon, 400 ml of dehydrated hexane, 0.8 mmol of triethyl aluminum and 0.004 mmol, converted as titanium atom, of titanium containing catalyst component produced in the above (1), were fed and heated to 90° C.

At this time the pressure within the system was 1.5 kg/cm$^2$G. Then hydrogen was supplied thereto to raise the pressure up to 5.5 kg/cm$^2$G and thereafter ethylene monomer gas was further supplied thereto so as to keep the whole pressure within the system at 9.5 kg/cm$^2$G. Thus the polymerization was conducted for 1 hour.

Ethylene polymer thus produced was 70 g and the polymerization activity of titanium-containing catalyst component was 365 kg/g-Ti-hr. Also MFR (190° C., 2.16 kg) of the polymer was 40.

(3) Ethylene polymerization on the ferrite magnetic material

Dehydrated hexane (500 ml) and 450 g of ferrite (volume average particle size: 50 μm) vacuum-dried (under 2 mmHg) at 200° C. for 3 hours, were introduced into an autoclave which had an inner volume of 1,000 ml and was purged by argon, at a room temperature and were stirred.

Then the mixture was heated to 40° C., to which the titanium-containing catalyst component prepared in the above (1), was added in amounts of 0.02 mmol converted as titanium atom. The reaction was carried out for 1 hour and thereafter 0.47 g carbon black (Ketchen black DJ-600, made by Lion Akuzo Co., Ltd.) were fed through an upper nozzle of the autoclave. Meanwhile the carbon black used was slurry prepared previously by vacuum-drying at 200° C. for 1 hour followed by addition of dehydrated hexane.

Thereafter the mixture was added by 2.0 mmol of triethyl aluminum and 2.0 mmol of diethyl aluminum chloride and was heated to 90° C. At this time the pressure within the system was 1.5 kg/cm$^2$G. Then hydrogen was supplied thereto to raise the pressure up to 2.0 kg/cm$^2$G and thereafter while ethylene monomer gas was further supplied continuously so as to maintain the whole pressure within the system at 6.0 kg/cm$^2$G, polymerization was carried out in the ferrite surface for 45 minutes, to give 469.3 g of polyethylene composition containing ferrite and carbon black.

Thus produced composition was uniformly black. An electron microscopic observation revealed that the ferrite surface was covered with a thin polyethylene layer, and that carbon black was dispersed uniformly in the thin layer. Meanwhile TGA (differential thermal analysis) of this composition showed the packing rate of ferrite of 95.5% by weight, which leads to a weight ratio between ferrite, polyethylene and carbon black of 24:1:0.025 as calculated from the supply amounts.

Thus obtained composition was treated in the hot airstream of 120° C. to conduct 2-hour treatment. The resultant heat-treated material was classified by means of 106 μm mesh sieve to remove aggregates and thus Carrier A was obtained, which had a volume average particle size of 53 μm and electric resistance of 3.5×10$^8$ Ω●. cm.

| (Carrier Preparation Example 2) | |
|---|---|
| Polyester resin (Mn: 5,000, Mw: 115,000, Tg: 67° C., softening point: 123° C.) | 100 parts by weight |
| Ferrite fine particles (MFP-2, made by TDK K.K.) | 500 parts by weight |
| Silica fine powder, serving as a dispersing agent (Aerosil #200, made by Nippon Aerosil K.K.) | 3 parts by weight |

-continued were mixed in Henschel Mixer and were kneaded by a biaxial extrusion kneader followed by cooling. Thus cooled mixture was pulverized roughly, further pulverized finely by a jet pulverizer and then classified by means of an air-classifier to give binder-type carrier particles having a volume average particle size of 60 μm and electric resistance of 3.5×10$^{11}$ Ω●cm, which served as Carrier B.

Recording medium

In the following Experiments and Comparative Examples, ordinary paper A which is commercially available one having a weighing of 64 g/m$^2$ (EP paper made by Minolta Co., Ltd.), ordinary paper B, which is commercially available one having a weighing of 80 g/m$^2$ (CF paper made by Minolta Co., Ltd.), and commercially available OHP film C (M-100, made by Minolta Co., Ltd.) were used as recording medium in A4 size.

Example: Cleaning Liquid Preparation Example 1

Tosclean D (made by Nagamune Sangyo K.K.) which is an aqueous solution containing a gelatinizer and a surfactant was diluted by ion exchanged water to give a water content of 80% by weight. This water-diluted Tosclean D of 100 parts by weight was added by 3 parts by weight of lipase A "Amano" 6 (a lipolytic enzyme, made by Amano Seiyaku K.K.), to which sodium hydroxide was further added in appropriate amounts to adjust a pH value to 8.0. The resultant solution was heated to 27° C., which served as Cleaning liquid A. Meanwhile Tosclean D contained: a mixture of divalent organic acid monoesters composed of monomethyl succinate, monomethyl glutamate, and monomethyl adipate, in amounts of about 26% by weight; polyoxyethylene-type surfactant in amounts of about 3% by weight; an organic acid mixture of oleic acid, palmitic acid and linolic acid in amounts of about 8% by weight; and water in amounts of about 60% by weight.

Example: Cleaning Liquid Preparation Example 2

The Cleaning liquid B was prepared in the same manner as in Cleaning Liquid Preparation Example 1 except that Lipase AY "Amano" 30 (made by Amano Seiyaku K.K.) was used in place of Lipase A "Amano" 6, and pH value and the liquid temperature were changed to 9.0° and 45° C. respectively.

Example: Cleaning Liquid Preparation Example 3

The Cleaning liquid C was prepared just in the same manner as in Cleaning Liquid Preparation Example 1 except that Lipase M "Amano" 10 (made by Amano Seiyaku K.K.) was employed as an enzyme to be added, and the pH value and the liquid temperature were changed respectively to 8.5° and 40° C.

Comparative Example: Cleaning Liquid Preparation Example 4

The Cleaning liquid D was prepared in the same way as in Cleaning Liquid Preparation Example 1 except that enzyme was not added to the cleaning liquid.

Comparative Example: Cleaning Liquid preparation Example 5

One hundred parts by weight of water, 2 parts by weight of sodium dialkylsulfo succinate (Pelex TR, made by Kao K.K.) serving as surfactant, and 3 parts by weight of Lipase A "Amano" 6 (made by Amano Seiyaku K.K.) were mixed together and the resultant was adjusted to have a pH value of 8.0 and a liquid temperature of 27° C. to give Cleaning liquid E.

Example: Cleaning Liquid Preparation Example 6

The Cleaning liquid F was prepared in the same way as in Cleaning Liquid Preparation Example 1 except that 100 parts by weight of Tosclean D diluted so as to give a water content of 60% by weight were added with 3 parts by weight of Bioprase APL30 (a liquid protease, made by Nagase Seikagaku Kogyo K.K.) as enzyme and that the pH value and liquid temperature were controlled to 7.0° and 23° C. respectively.

Example: Cleaning Liquid Preparation Example 7

The Cleaning liquid G was prepared just in the same manner as in Cleaning Liquid Preparation Example 1 except that glucose oxidase (an oxidoreductase) was used as enzyme to be added.

Test Examples 1–5

First test charts for cleaning tests were prepared on the aforementioned recording medium. Namely a developing agent was prepared by mixing 30 g of the above Toner B and 570 g of Carrier B. Using thus prepared developing agent, toner images were respectively reproduced on the previously mentioned ordinary paper A, B, and OHP film C by means of a commercially available copying machine EP-8600 (made by Minolta Co., Ltd.). Each toner image had a black area of 15% of the whole A4 size area and was in actual size of the original chart. Meanwhile thus formed toner image was reciprocatingly rubbed 3 times by a sand eraser under 1 kg load but no change was recognized visually in the all-over black area after that treatment.

Thus produced test charts were respectively immersed into pans which were filled with respective cleaning liquids A–E, at temperatures in which the respective liquids were prepared. Thereafter the charts were gently rubbed by wool to conduct cleaning. In order to evaluate the cleaning effect, the cleaning efficiencies were respectively measured in 20-second immersion and 60second immersion.

The cleaning efficiencies were determined from the following equation after the charts were taken out of the respective pans and were dried.

Equation 1

$$\text{Cleaning efficiency (\%)} = \frac{\text{Image density before cleaning} - \left(\text{Image density after cleaning} - \text{Recording medium density before image formation}\right)}{\text{Image density before cleaning}} \times 100$$

Meanwhile the image density was measure by Sakura-densitometer (made by Konica K.K.). The results thus obtained were shown in Table 1.

By the way 80% or more of the cleaning efficiency means practical availability as reclaimed paper and 90% or more means that the reclaimed paper is provided with considerable whiteness.

Test Example 6

Test charts were prepared in the same manner as in the above Test Examples 1–5 except that the developing agent was prepared by 25 g of Toner A and 475 g of Carrier A and that an employed copying machine was EP-4300 (made by Minolta Co., Ltd.). Cleaning effect was also evaluated in the same way as in Test Examples 1–5 except that the employed cleaning liquid was F. Results thus obtained were also shown in Table 1.

Test Example 7

Test charts were prepared in the same manner as in the above Test Example 6 except that the developing agent was prepared by 25 g of Toner C and 475 g of Carrier A. Cleaning effect was also evaluated in the same manner as in Test Examples 1–5 except that the employed cleaning liquid was F. Results are also shown in Table 1.

Test Example 8

Tests and the cleaning effect evaluation were conducted in the same way as in Test Examples 1–5 except that the Cleaning liquid G was used. Results thus obtained are also shown in Table 1.

TABLE 1

| | Test | | Cleaning | Cleaning efficiency (%) | | | | | |
|---|---|---|---|---|---|---|---|---|---|
| | | | | Ordinary paper: A | | Ordinary paper: B | | OHP: C | |
| | Expl. | Toner | liquid | 20-sec elapse | 60-sec elapse | 20-sec elapse | 60-sec elapse | 20-sec elapse | 60-sec elapse |
| Example 1 | 1 | B | A | 93.7 | 98.0 | 94.0 | 98.0 | 92.5 | 97.5 |
| Example-2 | 2 | B | B | 93.5 | 98.0 | 94.5 | 99.2 | 93.0 | 97.0 |
| Example 3 | 3 | B | C | 95.0 | 99.0 | 95.0 | 99.0 | 93.0 | 98.6 |

TABLE 1-continued

| | Test | | Cleaning | Cleaning efficiency (%) | | | | | |
|---|---|---|---|---|---|---|---|---|---|
| | | | | Ordinary paper: A | | Ordinary paper: B | | OHP: C | |
| | Expl. | Toner | liquid | 20-sec elapse | 60-sec elapse | 20-sec elapse | 60-sec elapse | 20-sec elapse | 60-sec elapse |
| Comparative 1 | 4 | B | D | 60.3 | 97.5 | 62.7 | 98.0 | 60.2 | 94.8 |
| Comparative 2 | 5 | B | E | 1.3 | 2.7 | 1.5 | 3.9 | 1.2 | 2.8 |
| Example 4 | 6 | A | F | 93.0 | 97.5 | 93.5 | 98.3 | 92.0 | 98.0 |
| Example 5 | 7 | C | F | 92.5 | 96.5 | 92.0 | 97.5 | 92.0 | 98.0 |
| Example 6 | 8 | B | G | 82.0 | 96.0 | 85.0 | 97.0 | 82.0 | 96.5 |

As is apparent from Test results, the present cleaning liquid containing water, gelatinizer and enzyme, can attain high quality cleaning in a extremely short time. For instance, the cleaning liquid of Test Example 4, which was free from enzymes, showed a satisfactory cleaning efficiency in 60-second immersion, whereas in short time immersion like 20 seconds it was inferior than those of Test Examples 1–3 and 6–8. As a consequence, it becomes clear that an efficient cleaning requires enzymes. This may be responsible for the toner existing deep in the network structure of paper fiber and for the special bonding between the toner and the surface treatment agent of OHP film. That the cleaning liquid of Test Example 5, which was free from gelatinizer, could not provide satisfactory cleaning effect leads to a conclusion that for cleaning the common toner resin component, a gelatinizer is necessary so as to gelatinize these resin components.

Further from Table 1, the present cleaning liquid can achieve satisfactory cleaning effect both on toners containing styrene-acrylic type resin component and on those containing polyester type resin component, and thus it can attain prominent cleaning effect regardless of kinds of resin components constituting the toner. Also the results exhibit that the present cleaning liquid is effective on toners containing dyestuffs such as nigrosine, etc.

Toner Preparation Example 4

The following materials were mixed in Henschel Mixer and were kneaded by a biaxial extrusion kneader followed by cooling.

| | |
|---|---|
| Styrene-acrylic copolymer resin (Mn: 5,200, Mw: 187,000, Tg: 61° C., Softening point 123° C.) | 100 parts by weight |
| Carbon black (Raven 1250, made by Colombia Carbon Co.) | 10 parts by weight |
| Low molecular weight polypropylene serving as an offset inhibitor (Viscol 550P, made by Sanyo Kasei Kogyo K.K.) | 3 parts by weight |

Then the resultant was pulverized roughly, further pulverized finely by a jet pulverizer and then classified by means of an air classifier to give resinparticles having a volume average particle size of 9.5 μm.

Thus obtained particles were treated by hydrophobic silica serving as a fluidizer, of 0.3% by weight, to give Toner D.

Toner Preparation Example 5

The following materials were mixed in Henschel Mixer and were kneaded by a biaxial extrusion kneader followed by cooling.

| | |
|---|---|
| Polyester resin (Mn: 4,300, Mw: 235,000, Tg: 65° C., softening point: 123° C.) | 100 parts by weight |
| Carbon black (Mogul L, made by Cabot K.K.) | 10 parts by weight |
| Low molecular weight, oxidized type polypropylene serving as an offset inhibitor (Viscol TS 200, made by Sanyo Kasei Kogyo K.K.) | 3 parts by weight |
| Charge controller (Bontron E-89, made by Orient Kagaku Kogyo K.K.) | 3 parts by weight |

Then the cooled mixture was pulverized roughly, further pulverized finely by a jet pulverizer and then classified by an air classifier, to give resin-particles having a volume average particle size of 8.3 μm.

Thus obtained resin particles were further treated by hydrophobic titanium oxide serving as a fluidizer, of 0.5% by weight to give Toner E.

Recording medium

Recording medium used in the following Examples and Comparative Examples were all ordinary paper in A4 size having a weighing of 64 g/cm$^2$.

Example 7

A cleaning liquid was prepared by blending 70 parts by weight of acetone serving as a solvent, about 0.2 parts by weight of sodium dodecylbenzene sulfonate serving as a surfactant, and 5 parts by weight of cellulase A (hydrolyric enzyme, made by Amano Seiyaku K.K.) and by adding thereto 30 parts by weight of water (ion exchanged water) of which pH value was adjusted to 4.5.

Separately test charts, by which the cleaning tests were carried out, were prepared in the following way. Toner D (25 g) obtained in Toner Preparation Example 4, and 475 g of carrier A prepared in Carrier Preparation Example 1 were mixed together to give a developer. By the use of thus obtained developer, images were reproduced on the above described ordinary paper by means of EP-4300 copying machine (made by Minolta Co., Ltd.) to obtain test charts. The test chart had copy images reproduced from a manuscript having a black area of 15% of the whole A4 size area. The produced chart, after fixation, was reciprocatingly rubbed by 3 times by a sand eraser under approx. 1 kg load but changes were scarcely observed visually in the over-all black area, i.e., the fixation was almost complete.

The test charts were immersed in a pan which was filled with the previously prepared cleaning liquid, at a room temperature for 30 seconds and 60 seconds, respectively.

After 30 seconds or 60 seconds, respective image parts were rubbed in the cleaning liquid gently by cotton wool to carry out cleaning. The respective image parts were cleaned almost completely.

Thereafter the test charts after cleaning were taken out of the pan and dried. The resultant showed sufficient strength. Also the cleaning efficiencies (%) were respectively determined just in the same way as previously described.

Meanwhile image reproduction using thus reclaimed paper as above, was carried out again, of which results were evaluated visually. The evaluation results are also shown in Table 2, in which: @designates that the reclaimed paper is almost identical with the original paper; o designates that the reclaimed paper is practically available for use; Δ designates that the reclaimed paper is a little contaminated; and x designates that the reclaimed paper seems to be hardly cleaned.

Example 8

The cleaning liquid was prepared in the same way as in Example 7 except that glucose oxidase (oxidoreductase) was used as enzyme and that a pH value was adjusted to 7.

The cleaning tests were carried out in the same way as in Example 7 using the test charts prepared as above. The charts after cleaning showed sufficient strength. Also the cleaning efficiencies were evaluated just in the same manner as in Example 7, of which results are shown in Table 2.

Example 9

The cleaning liquid was prepared by blending 75 parts by weight of dioxane, 1.0 part by weight of sodium dialkylsulfo succinate (Pelex TR, made by Kao K.K.), 10 parts by weight of Bioprase Clean W (a hydrolytic enzyme, made by Nagase Sangyo K.K.), and 25 parts by weight of water (ion exchanged water), and the resultant mixture was adjusted to have a pH value of 8.

The cleaning tests were conducted in the same way as in Example 7 using the test charts prepared as described above. The test charts after cleaning treatment showed sufficient strength. The cleaning efficiencies were also evaluated in the same manner as in Example 7, of which results are shown in Table 2.

Experiment 10

The cleaning liquid was prepared by blending 80 parts by weight of cyclohexane, serving as a solvent compatible with water, 2 parts by weight of sodium laurate, serving as a surfactant, and 3 parts by weight of nucleoside serving as a transferase.

The mixture was further added with an aqueous mixture containing 1 part by weight of propionic acid serving as an organic acid and 20 parts by weight of water (ion exchanged water), and the resultant mixture was adjusted to have a pH value of 4.0.

Separately test charts for cleaning tests were produced. First the developer was prepared by mixing 30 g of Toner E prepared in Toner Preparation Example 5, and 570 g of Carrier B prepared in Carrier Preparation Example 2. Then the test charts were prepared just in the same way as in Example 7 by means of EP-8600 copying machine (made by Minolta Co., Ltd.).

Thereafter cleaning tests were carried out in the same way as in Example 7 using thus prepared test charts. The charts after cleaning showed satisfactory strength. Also cleaning efficiencies were evaluated just in the same manner as in Example 7, of which results are shown in Table 2.

Example 11

The cleaning liquid was prepared in such a way that: 40 parts by weight of water (ion exchanged water) were added with 60 parts by weight of tetrahydrofuran, 1 part by weight of sodium laurate as a surfactant, and 8 parts by weight of aspartase (a lyase) and then a pH value of the resultant mixture was adjusted to 3.6.

The cleaning tests were conducted using the test charts prepared in Example 10 and in the same manner as in Example 7. The charts after cleaning showed satisfactory strength. Also the cleaning efficiencies were evaluated in the same manner as in Example 7, of which results are shown in Table 2.

Experiment 12

The cleaning liquid was prepared in the same way as in Example 11 except that 10 parts by weight of fumarase (a lyase) were used.

Using the tests charts prepared in Example 10, the cleaning tests were carried out in the same manner as in Example 7. The test charts after cleaning showed sufficient strength. Also the cleaning efficiencies were evaluated in the same way as in Example 7, of which results are shown in Table 2.

Example 13

The cleaning liquid was prepared in such a way that: 40 parts by weight of water (ion-exchanged water) were added with 60 parts by weight of acetone, serving as a solvent compatible with water, 0.5 parts by weight of sodium laurate serving as a surfactant and 15 parts by weight of D-amino acid lasemaze (an isomerase) and a pH value of the resultant mixture was adjusted to 8.0.

Separately, test charts were prepared in the same way as in Example 7 except that the developer composed of 25 g of Toner C obtained in Toner preparation Example 3 and 475 g of Carrier B obtained in Carrier Preparation Example 2, was employed. Then the cleaning tests were conducted using thus prepared test charts just in the same way as in Example 7. The charts after cleaning showed sufficient strength. Also the cleaning efficiencies were evaluated in the same manner as in Example 7, of which results are shown in Table 2.

Comparative Example 3

The cleaning tests were carried out just in the same manner as in Example 7 except that the cleaning liquid employed was free from enzymes. The cleaning efficiencies were also evaluated in the same way as in Example 7, of which results are shown in Table 2.

Comparative Example 4

The cleaning tests were conducted just in the same manner as in Example 7 except that the cleaning liquid employed was free from acetone. The cleaning efficiencies were also evaluated in the same way as in Example 7, of which results are shown in Table 2.

TABLE 2

| | Cleaning efficiency (%) | | Evaluation by naked eyes | |
|---|---|---|---|---|
| | 30-sec elapse | 60-sec elapse | 30-sec elapse | 60-sec elapse |
| Example 7 | 90.5 | 94.8 | ◎ | ◎ |
| Example 8 | 85.9 | 90.9 | ○ | ◎ |
| Example 9 | 91.4 | 96.3 | ◎ | ◎ |
| Example 10 | 82.6 | 89.9 | ○ | ○ |
| Example 11 | 87.1 | 91.0 | ○ | ◎ |
| Example 12 | 84.5 | 90.6 | ○ | ◎ |
| Example 13 | 81.8 | 88.9 | ○ | ○ |
| Comp. Ex. 3 | 66.3 | 90.1 | Δ | ◎ |
| Comp. Ex. 4 | 2.1 | 4.6 | x | x |

What is claimed is:

1. A cleaning liquid which will remove an image forming material containing a resin component from a surface of a recording medium comprising 30–90% by weight water, 5–60% by weight of an monoester of a divalent organic acid compatible with water wherein the monoester of divalent organic acid is represented by the following chemical formula: $HOOC—(CH_2)_n—COOR_1$ in which $R_1$ denotes an alkyl group of carbon numbers of 1–5 and n denotes an integer of 0–8, and 0.001–20% by weight of an enzyme.

2. The cleaning liquid according to claim 1, wherein the monoester of divalent organic acid is at least one compound selected from the group consisting of oxalic acid monoester, malonic acid monoester, succinic acid monoester, glutaric acid monoester, adipic acid monoester, pimelic acid monoester, suberic acid monoester, azelic acid monoester, and sebacic acid monoester.

3. The cleaning liquid according to claim 1, wherein the enzyme is at least one selected from the group consisting of hydrolase, oxidoreductase, transferase, lyase, and isomerase.

4. The cleaning liquid according to claim 1, wherein the enzyme is at least one selected from the group consisting of lipase, protease, amylase, and cellulase.

5. The cleaning liquid according to claim 1, wherein the liquid has a pH value of 2–11.

6. The cleaning liquid according to claim 1, further containing a surfactant.

7. The cleaning liquid according to claim 6, wherein the surfactant is contained at an amount of 0.01–10% by weight.

8. The cleaning liquid according to claim 6, wherein the surfactant is at least one selected from the group consisting of anionic surfactants, nonionic surfactants, cationic surfactants, and amphoteric surfactants.

9. The cleaning liquid according to claim 1, further containing an organic acid.

10. The cleaning liquid according to claim 9, wherein the organic acid is contained at an amount of 1–15% by weight.

* * * * *